US010503094B2

(12) United States Patent
Suzuki

(10) Patent No.: US 10,503,094 B2
(45) Date of Patent: Dec. 10, 2019

(54) DEVELOPMENT ROLLER

(71) Applicant: SUMITOMO RUBBER INDUSTRIES, LTD., Hyogo (JP)

(72) Inventor: Daijiro Suzuki, Hyogo (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 16/186,608

(22) Filed: Nov. 12, 2018

(65) Prior Publication Data

US 2019/0227457 A1 Jul. 25, 2019

(30) Foreign Application Priority Data

Jan. 23, 2018 (JP) ..... 2018-009068

(51) Int. Cl.
*G03G 15/08* (2006.01)

(52) U.S. Cl.
CPC . *G03G 15/0818* (2013.01); *G03G 2215/0861* (2013.01)

(58) Field of Classification Search
CPC ..... G03G 15/0818; G03G 2215/0861
USPC ..... 399/279, 286; 492/18, 56, 59; 430/123.3
See application file for complete search history.

(56) References Cited

U.S. PATENT DOCUMENTS

2003/0086730 A1* 5/2003 Nakamura ..... G03G 15/0818 399/286
2006/0183615 A1* 8/2006 Eun ..... G03G 15/0233 492/56
2007/0243984 A1* 10/2007 Mizumoto ..... G03G 15/0818 492/49
2016/0041491 A1* 2/2016 Suzuki ..... G03G 15/0233 399/176
2016/0139534 A1* 5/2016 Suzuki ..... G03G 15/0818 399/286

FOREIGN PATENT DOCUMENTS

JP 2000347497 A * 12/2000
JP 2006106323 A * 4/2006
JP 2014080456 5/2014

* cited by examiner

*Primary Examiner* — Robert B Beatty
(74) *Attorney, Agent, or Firm* — JCIPRNET

(57) ABSTRACT

Provided is a development roller which is capable of improving a black solid density and a 2-dot density simultaneously to form a satisfactory image with excellent contrast and thin line reproducibility. A development roller includes a roller body that contains a tubular inner layer consisting of an elastic material and an outer layer consisting of an elastic material, a roller resistance value $R_1$ (Ω, an applied voltage of 400 V) in a state when there is only the inner layer satisfies formula (1):

$$6.5 \leq \log R_1 \leq 9.5 \quad (1),$$

and a volume resistivity $R_2$ (Ω·cm, an applied voltage of 400 V) in a state when there is only the outer layer satisfies formula (2):

$$\log R_2 \leq 9.0 \quad (2).$$

12 Claims, 2 Drawing Sheets

DEVELOPMENT ROLLER

CROSS-REFERENCE TO RELATED APPLICATION

This application claims the priority of Japan patent application serial no. 2018-009068, filed on Jan. 23, 2018. The entirety of the above-mentioned patent application is hereby incorporated by reference herein and made a part of this specification.

BACKGROUND OF THE DISCLOSURE

Technical Field

The present disclosure relates to a development roller which is incorporated and used in an image-forming device using electrophotography.

Description of Related Art

A development roller is known to include a single-layer roller body which is obtained, for example, by the cross-linking a rubber composition which contains a diene rubber and an ion conductive rubber after the rubber composition is formed into a tubular shape. Besides, an oxide film may be formed on an outer periphery surface of the single-layer roller body by ultraviolet ray irradiation and the like (see patent literature 1 and so on).

An image-forming device incorporated with the development roller may be, for example, a laser printer, an electrostatic copying machine, a plain paper facsimile device, or a compound machine thereof.

As one of the image evaluation standard of the image-forming device such as a laser printer, the black solid density and 2-dot density are known.

The black solid density is the density of a black solid image with a totally black paper surface. The higher the black solid density is, the easier to form a high-contrast image. Besides, the 2-dot density is the density of an image called isolated 2-dot in which circles are positioned in parallel on a square grid with a grid length of about 80 μm. The higher the 2-dot density is, the easier to improve the thin line reproducibility of the formed image and to form an image which is not blurred.

However, the two kinds of image densities are in a contrary relation and are difficult to be satisfied simultaneously. That is, the lower the roller resistance value of the development roller is, the higher the black solid density tends to be; the higher the roller resistance value of the development roller, the higher the 2-dot density tends to be. In an existing development roller, it is difficult to satisfy the two contrary properties simultaneously.

[Patent literature 1] Japanese Laid-open Application No. 2014-80456

SUMMARY

The present disclosure provides a development roller which is capable of simultaneously improving both the black solid density and the 2-dot density to form a satisfactory image having excellent contrast and thin line reproducibility.

The present disclosure is a development roller including a roller body, and the roller body includes a tubular inner layer which consists of an elastic material and an outer layer which consists of an elastic material and is laminated on an outer periphery surface of the inner layer, a roller resistance value $R_1$ (Ω, an applied voltage of 400 V) in a state when there is only the inner layer satisfies formula (1):

$$6.5 \leq \log R_1 \leq 9.5 \quad (1),$$

and a volume resistivity $R_2$ (Ω·cm, an applied voltage of 400 V) in a state when there is only the outer layer satisfies formula (2):

$$\log R_2 \leq 9.0 \quad (2).$$

DESCRIPTION OF THE EMBODIMENTS

Figure 1A:
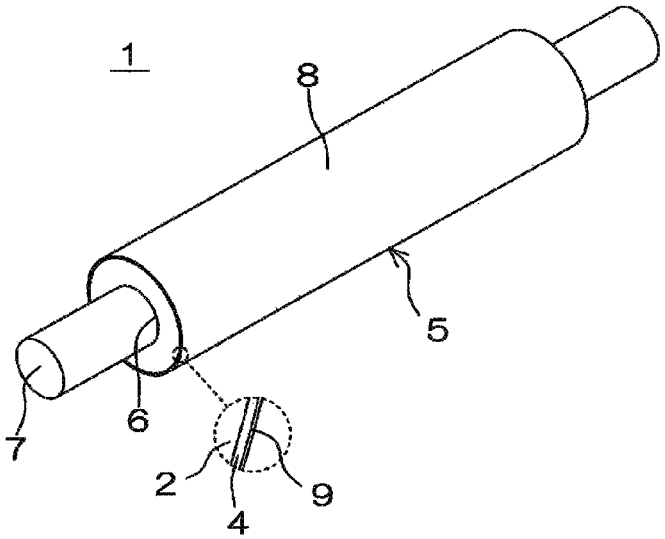
FIG. 1A is a perspective view showing an overall appearance of an example of a development roller of the present disclosure.

According to the present disclosure, a development roller which is capable of simultaneously improving both the black solid density and the 2-dot density to form a satisfactory image having excellent contrast and thin line reproducibility can be provided.

According to the study by the inventor, the black solid density is related to a resistance value in the vicinity of a surface of a roller body, and the black solid density can be increased if the resistance value in the vicinity of the surface is lowered. On the other hand, the 2-dot density is related to an overall roller resistance value of the roller body, and the higher the overall roller resistance value is, the more easily to increase the 2-dot density.

Therefore, based on these findings, the inventor conducted further studies and found that, as mentioned above, the roller body is set to a structure which includes an inner layer and an outer layer laminated on an outer periphery surface of the inner layer, both of which consist of an elastic material, and in order to adjust the resistance value in the vicinity of the surface of the roller body to a range in which the black solid density may be increased, the outer layer is set to a low resistance state in which a volume resistivity $R_2$ of the sheer outer layer, represented by a common logarithm value log $R_2$, is in a range below 9.0, and in order to adjust the overall roller resistance value of the roller body also including the outer layer to a range in which the 2-dot density may be increased, the inner layer under the outer layer is set to a high resistance state in which a roller resistance value $R_1$ of the sheer inner layer, represented by a common logarithm value log $R_1$, is in a range from 6.5 or more to 9.5 or less.

That is, as mentioned above, the present disclosure is a development roller including a roller body, the roller body includes a tubular inner layer which consists of an elastic material and an outer layer which consists of an elastic material and is laminated on an outer periphery surface of the inner layer, a roller resistance value $R_1$ (Ω, an applied voltage of 400 V) in a state when there is only the inner layer satisfies formula (1):

$$6.5 \leq \log R_1 \leq 9.5 \quad (1),$$

and a volume resistivity $R_2$ (Ω·cm, an applied voltage of 400 V) in a state when there is only the outer layer satisfies formula (2):

$$\log R_2 \leq 9.0 \quad (2).$$

Therefore, according to the present disclosure, by setting the roller body to the two-layer structure described above, a development roller which is capable of simultaneously improving both the black solid density and the 2-dot density to form a satisfactory image having excellent contrast and thin line reproducibility can be provided. FIG. 1A is a perspective view showing an overall appearance of an example of the development roller of the present disclosure, and FIG. 1B is an end view of the example of the development roller.

Figure 1B:
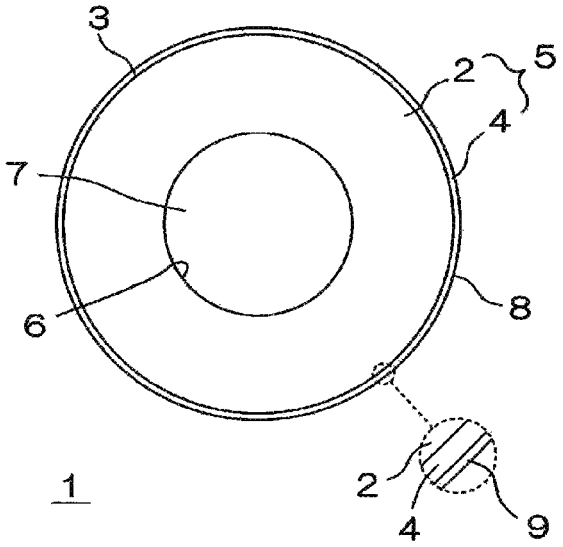
FIG. 1B is an end view of the example of the development roller.

Referring to FIG. 1A and FIG. 1B, a development roller 1 of the example includes a two-layer roller body 5 which is formed by directly laminating an outer layer 4 consisting of an elastic material to an outer periphery surface 3 of a tubular inner layer 2 consisting of an elastic material.

A shaft 7 is inserted and fixed to a through hole 6 at the center of the inner layer 2. The shaft 7 is integrally formed by metals such as aluminum, aluminum alloys, stainless steel and the like.

The shaft 7 is electrically coupled to and mechanically fixed to the roller body 5 via a conductive adhesive agent for example, or is electrically coupled to and mechanically fixed to the roller body 5 by pressing a shaft 7 having an external diameter larger than an internal diameter of the through hole 6 into the through hole 6. Besides, as enlarged and shown in the two drawings, an oxide film 9 is formed on a surface of the outer layer 4, that is, on an outer periphery surface 8 of the roller body 5.

By the formation of the oxide film 9, the oxide film 9 can function as a dielectric layer and reduce the dielectric loss tangent of the development roller 1. Also, the oxide film 9 can function as a low friction layer and effectively suppress the adhesion of a toner.

In addition, the oxide film 9 can be easily formed by, for example, oxidizing the rubber near the outer periphery surface 8 by means of the ultraviolet ray irradiation to the outer periphery surface 8 in an oxidizing atmosphere, and thus a decrease in the productivity of the development roller 1 or an increase in the manufacturing cost can also be suppressed.

However, the oxide film 9 may also be omitted.

Preferably, both the inner layer 2 and the outer layer 4 are formed to a non-porous single layer in order to simplify the respective structure and improve the durability and so on. In addition, the "single layer" of the outer layer 4 means that there is only one layer of the layer consisting of an elastic material. Besides, the "two layers" of the roller body 5 means that there are two layers, namely the inner layer 2 and the outer layer 4, both of which consist an elastic material; in both cases, the oxide film 9 formed by the ultraviolet ray irradiation and the like is not included in the layers.

In the present disclosure, the roller resistance value $R_1$ (Ω, an applied voltage of 400 V) in a state when there is only the inner layer 2 and the volume resistivity $R_2$ (Ω·cm, an applied voltage of 400 V) in a state when there is only the outer layer 4 are respectively limited to the above-mentioned range based on the following reasons. That is, when the volume resistivity $R_2$, represented by the common logarithm value log $R_2$, is above 9.0, the resistance value in the vicinity of the surface of the roller body 5 cannot be sufficiently reduced to a range in which the black solid density can be increased. Therefore, the black solid density is insufficient and the contrast of the formed image decreases.

Besides, if the roller resistance value $R_1$, represented by the common logarithm value log $R_1$, is below 6.5, the overall roller resistance value of the roller body 5 which also includes the outer layer 4 having the above-mentioned volume resistivity $R_2$ cannot be sufficiently increased to a range in which the 2-dot density can be raised. Therefore, the 2-dot density is insufficient, the reproducibility of thin lines in the formed image decreases and the formed image tends to be blurred.

On the other hand, when the roller resistance value $R_1$, represented by the common logarithm value log $R_1$, is above 9.5, the overall roller resistance value of the roller body 5 which also includes the outer layer 4 becomes excessively high, so that the black solid density is insufficient and the contrast of the formed image decreases.

In view of this, by setting the roller resistance value $R_1$ and the volume resistivity $R_2$ to the above-mentioned range respectively, the black solid density and the 2-dot density can be improved simultaneously to form a satisfactory image having excellent contrast and thin line reproducibility.

In addition, preferably, an overall roller resistance value $R_3$ (Ω, an applied voltage of 400 V) of the roller body 5 including the inner layer 2 and the outer layer 4 satisfies formula (3):

$$5.0 \leq \log R_3 \leq 8.7 \quad (3).$$

By setting the roller resistance value $R_3$ to the above-mentioned range, the effect of improving the black solid density and the 2-dot density simultaneously to form a satisfactory image having excellent contrast and thin line reproducibility can be further enhanced.

<Measurement of Roller Resistance Value>

In the present disclosure, the roller resistance value $R_1$ of the inner layer 2 or the overall roller resistance value $R_3$ of the roller body 5 is represented respectively by a value which is measured in a way mentioned below under a normal temperature and normal humidity environment with a temperature of 23° C. and a relative humidity of 55%.

Figure 2:
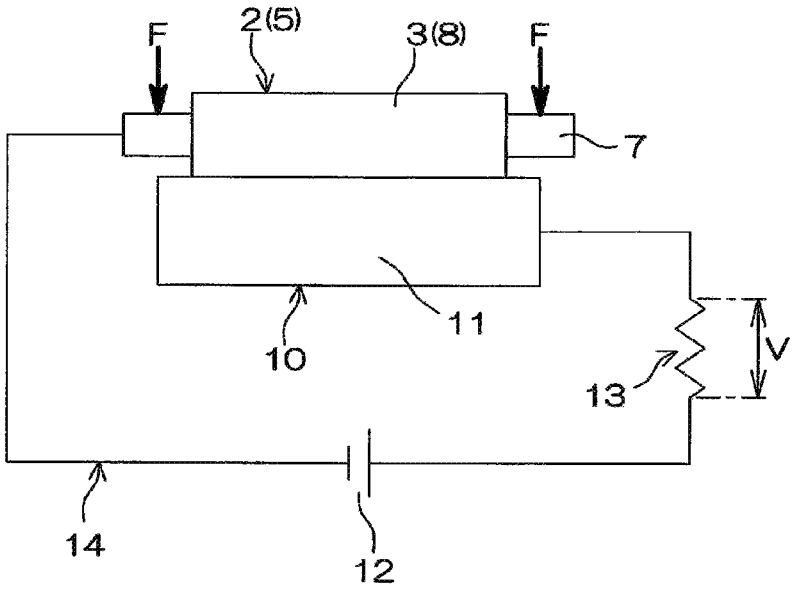
FIG. 2 is a drawing showing a method for measuring a roller resistance value of an inner layer or of an entire development roller.

FIG. 2 is a drawing illustrating the method for measuring the roller resistance value of the inner layer 2 or the roller body 5.

Referring to FIG. 1A, FIG. 1B and FIG. 2, first, an aluminum drum 10 capable of rotating at a specific rotation speed is prepared, and an outer periphery surface 11 of the aluminum drum 10 is made to contact, from above, with the outer periphery surface 3 of the inner layer 2 before the formation of the outer layer 4 or with the outer periphery surface 8 of the roller body 5.

Besides, a direct-current power supply 12 and a resistor 13 are connected in series between the shaft 7 and the aluminum drum 10 to form a measuring circuit 14. In the direct-current power supply 12, the (−) side is connected to the shaft 7 and the (+) side is connected to the resistor 13. A resistance value r of the resistor 13 is 100Ω. Next, a load F of 450 g is applied to two ends of the shaft 7 respectively to rotate the aluminum drum 10 at 40 rpm in a state when the inner layer 2 or the roller body 5 is pressed against the aluminum drum 10. Then, a detection voltage V applied to the resistor 13 is measured when a direct-current applied voltage E of 400 V is applied, between the inner layer 2 or the roller body 5 and the aluminum drum 10, from the direct-current power supply 12 while the rotation continues.

The roller resistance value $R_1$ or $R_3$ (represented by "R" in the following formula) of the inner layer 2 or the roller body 5 is basically calculated from the detection voltage V and the applied voltage E (=400 V) by formula (i'):

$$R = r \times E/V - r \quad (i').$$

Meanwhile, the −r in formula (i') has little influence, and thus in the present disclosure, the roller resistance value $R_1$ of the inner layer 2 or the roller resistance value $R_3$ of the roller body 5 is represented by a value calculated by formula (i):

$$R=r\times E/V \quad \text{(i).}$$

<Measurement of Volume Resistivity>

The volume resistivity $R_2$ of the outer layer 4 is represented by a value measured in a way mentioned below under a normal temperature and normal humidity environment with a temperature of 23° C. and a relative humidity of 55%.

That is, the rubber composition, which is the base of the outer layer 4, is pressed to form a 13 cm squared sheet with a thickness of 2 mm, and the sheet is used as a test piece to calculate the volume resistivity $R_2$ of the outer layer 4 according to a measuring method recited in the section of "Rubber, vulcanized or thermoplastic-Determination of resistivity-Part 1: Guarded-electrode system" in Japanese Industrial Standard JIS K6271-1:2015.

«Rubber Composition for the Inner Layer 2»

The inner layer 2 can be formed by various elastic materials satisfying the above-mentioned roller resistance value $R_1$. In particular, the inner layer 2 is preferably formed by a cross-linked product of the rubber composition which contains a diene rubber, an ethylene propylene diene rubber (EPDM), and carbon black.

<Diene Rubber>

The diene rubber may be one or two of, for example, a natural rubber, an isoprene rubber (IR), a butadiene rubber (BR), a styrene butadiene rubber (SBR), a chloroprene rubber (CR), an acrylonitrile butadiene rubber (NBR) and so on.

The IR is particularly preferable.

(IR)

The IR may be any kind of IR obtained by artificially reproducing the structure of the natural rubber.

Besides, the IR may be an oil-extended IR to which extender oil is added to adjust the flexibility or a non-oil-extended IR without extender oil; in the present disclosure, in order to prevent the pollution from a photoreceptor, a non-oil-extended IR not containing extender oil which may become bleeding substance is preferably used.

One or more than two kinds of these IRs can be used.

<EPDM>

Any copolymer obtained by copolymerizing ethylene, propylene and diene may be used as the EPDM. The diene may be ethylidene norbornene (ENB), dicyclopentadiene (DCPD) and so on.

Besides, the EPDM may be an oil-extended EPDM to which extender oil is added to adjust the flexibility or a non-oil-extended EPDM without extender oil; again, in the present disclosure, in order to prevent the pollution from a photoreceptor, a non-oil-extended EPDM not containing extender oil which may become bleeding substance is preferably used.

One or more than two of these EPDMs may be listed.

(Combination Ratio of Rubber)

A combination ratio of the diene rubber to the EPDM can be optionally determined based on properties required by the inner layer 2, in particular, on the roller resistance value $R_1$ and the flexibility of the inner layer 2.

<Carbon Black>

Carbon black has a function of making the inner layer 2 electronic conductive to adjust the roller resistance value $R_1$ of the inner layer 2 to the above-mentioned range.

Carbon black may be, for example, one or more than two of Denka Black (registered trademark) manufactured by Denka Company Limited, Ketjen black (registered trademark) EC300J, Lionite (registered trademark) CB manufactured by Lion Corporation and so on.

Preferably, the combination ratio of carbon black is more than 6 parts by mass and less than 10 parts by mass with respect to a total amount of 100 parts by mass of rubber.

<Cross-Linking Component>

Preferably, the cross-linking component is a combination of a cross-linking agent which cross-links the rubber and a cross-linking accelerator which accelerates the cross-linking of rubber performed by the cross-linking agent.

The cross-linking agent herein may be, for example, a sulfur-based cross-linking agent, a thiourea-based cross-linking agent, a triazine derivative cross-linking agent, a peroxide cross-linking agent, all kinds of monomer and so on. The sulfur-based cross-linking agent is especially preferable.

(Sulfur-Based Cross-Linking Agent)

The sulfur-based cross-linking agent may be, for example, sulfur such as powder sulfur, oil-treated powder sulfur, precipitated sulfur, colloidal sulfur, dispersible sulfur and the like, or organic sulfur-containing compound such as tetramethylthiuram disulfide, N,N-dithio bis-morpholine and the like, and sulfur is especially preferable.

Preferably, the combination ratio of sulfur is more than 0.5 parts by mass and less than 2 parts by mass with respect to a total amount of 100 parts by mass of rubber.

Sulfur is used to effectively cross-link the rubber to give the inner layer 2 excellent properties as rubber, that is, properties such as flexibility, low compression set and low tendency of deterioration; however, if the combination ratio of sulfur is below the range, there is concern that the above-mentioned effect may not be sufficiently obtained.

On the other hand, when the combination ratio is above the range, there is concern that the excessive sulfur may bloom in the outer periphery surface 3 of the inner layer 2, which is the interface of the inner layer 2 and the outer layer 4, and hinder the attachment of the outer layer 4.

In addition, for example, when oil-treated powder sulfur, dispersible sulfur and the like are used as the sulfur, the combination ratio refers to the ratio of sulfur which serves as the effective component contained therein.

Besides, when organic sulfur-containing compound is used as the cross-linking agent, the combination ratio is preferably adjusted so that the ratio of sulfur contained in molecules with respect to a total amount of 100 parts by mass of rubber is within the range.

(Cross-Linking Accelerator)

The cross-linking accelerator for accelerating the rubber cross-linking performed by the sulfur-based cross-linking agent may be, for example, one or more than two of a thiazole-based accelerator, a thiuram-based accelerator, a sulfenamide-based accelerator, a dithiocarbamate-based accelerator and the like. Wherein, the combined use of a thiuram-based accelerator and a thiazole-based accelerator is preferable.

The thiuram-based accelerator may be, for example, one or more than two of tetramethylthiuram monosulfide, tetramethylthiuram disulfide, tetraethylthiuram disulfide, tetrabutylthiuram disulfide, dipentamethylene thiuram tetrasulfide and the like. Besides, the thiazole-based accelerator may be, for example, one or more than two of 2-mercaptobenzothiazole, di-2-benzothiazolyl disulfide, zinc salt of 2-mercaptobenzothiazole, cyclohexylamine salt of 2-mercaptobenzothiazole, 2-(4'-morpholinodithio) benzothiazole and the like.

In a system where two kinds of the cross-linking accelerator are used together, in consideration of sufficiently exhibiting the effect of the sulfur-based cross-linking agent to accelerate the cross-linking of rubber, the combination ratio of the thiuram-based accelerator is preferably more than 0.3 parts by mass and less than 2 parts by mass with respect to a total amount of 100 parts by mass of rubber. Besides, the combination ratio of the thiazole-based accelerator is preferably more than 0.3 parts by mass and less than 2 parts by mass with respect to a total amount of 100 parts by mass of rubber.

<Others>

Various additive agents may be combined into the rubber composition for the inner layer 2 when necessary. The additive agent may be, for example, a cross-linking accelerator aid, a plasticizer, a processing aid, a deterioration inhibitor and the like. Wherein, the cross-linking accelerator aid may be, for example, one or more than two of metal compounds such as zinc flower (zinc oxide), fatty acid such as stearic acid, oleic acid, cotton seed oil fatty acid, and other publicly known cross-linking accelerator aids.

The combination ratio of the cross-linking accelerator aid is individually preferably more than 0.1 parts by mass, in particular, more than 0.5 parts by mass with respect to a total amount of 100 parts by mass of rubber, and is preferably less than 7 parts by mass, in particular less than 5 parts by mass. The plasticizer may be, for example, various plasticizers such as dibutyl phthalate, dioctyl phthalate, tricresyl phosphate, or various waxes such as a polar wax. Besides, the processing aid may be, for example, a fatty acid metal salt such as stearic acid zinc.

The combination ratio of the plasticizer and/or the processing aid is preferably less than 3 parts by mass with respect to a total amount of 100 parts by mass of rubber. The deterioration inhibitor may be various age inhibitors, oxidation inhibitor and the like. Wherein, the oxidation inhibitor may be, for example, 4,4'-dicumyldiphenylamine.

The combination ratio of the oxidation inhibitor is preferably more than 0.1 parts by mass with respect to a total amount of 100 parts by mass of rubber, and is preferably less than 2 parts by mass.

Besides, a filler, an anti-scorching agent, a lubricant, a pigment, an antistatic agent, a flame retardant, a neutralizer, a nucleating agent, a co-cross-linking agent and the like may be further added at an optional ratio as the additive agent.

<Preparation of Rubber Composition>

The rubber composition for the inner layer 2 containing the component described above can be prepared in an existing way. First, the rubber is masticated, next, various additive agents except the cross-linking component are added for kneading, and the cross-linking component is added at last for kneading, thereby obtaining the rubber composition for the inner layer 2. The kneading can be performed by, for example, a kneader, a banbury mixer, an extruding machine and the like.

«Rubber Composition for the Outer Layer 4»

The outer layer 4 can be formed by various elastic materials satisfying the above-mentioned volume resistivity $R_2$. In particular, the outer layer 4 is preferably formed by a cross-linked product of a rubber composition containing an epichlorohydrin rubber and a diene rubber.

<Epichlorohydrin Rubber>

Various polymers which contain epichlorohydrin as a recurring unit and have ion conductivity can be used as the epichlorohydrin rubber.

The epichlorohydrin rubber may be, for example, one or more than two of an epichlorohydrin homopolymer, an epichlorohydrin-ethylene oxide bicopolymer (ECO), an epichlorohydrin-propylene oxide bicopolymer, an epichlorohydrin-allyl glycidyl ether bicopolymer, an epichlorohydrin-ethylene oxide-allyl glycidyl ether tercopolymer (GECO), an epichlorohydrin-propylene oxide-allyl glycidyl ether tercopolymer, an epichlorohydrin-ethylene oxide-propylene oxide-allyl glycidyl ether tetracopolymer and the like.

Among these compositions, when being used together with a diene rubber, a copolymer containing an ethylene oxide, in particular, ECO and/or GECO is preferable in terms of the effect of decreasing the volume resistivity $R_2$ of the outer layer 4 to a suitable range.

For both of the two copolymers, the ethylene oxide content is preferably more than 30 mol %, in particular more than 50 mol %, and is preferably less than 80 mol %.

The ethylene oxide has a function of decreasing the volume resistivity $R_2$ of the outer layer 4. However, if the ethylene oxide content is not within the range, there is concern that the function is not sufficiently obtained, and thus the volume resistivity $R_2$ of the outer layer 4 cannot be sufficiently decreased.

On the other hand, when the ethylene oxide content is above the range, crystallization of the ethylene oxide occurs and the segmental motion of molecule chains is obstructed, and thus in reverse, there is a tendency that the volume resistivity $R_2$ of the outer layer 4 increases. Besides, there is also concern that the outer layer 4 after the cross-linking becomes too hard, or a heat-melting viscosity of the rubber composition before cross-linking increases and the processability decreases.

The epichlorohydrin content in ECO is the remaining amount of the ethylene oxide content. That is, the epichlorohydrin content is preferably more than 20 mol %, and is preferably less than 70 mol %, in particular, less than 50 mol %.

Besides, the allyl glycidyl ether content in GECO is preferably more than 0.5 mol %, in particular, more than 2 mol %, and is preferably less than 10 mol %, in particular, less than 5 mol %.

The allyl glycidyl ether has a function of suppressing the crystallization of the ethylene oxide and decrease the volume resistivity $R_2$ of the outer layer 4 by the allyl glycidyl ether itself functioning to ensure a free volume as a side chain. However, if the allyl glycidyl ether content is below the range, there is concern that the function is not sufficiently obtained and thus the volume resistivity $R_2$ of the outer layer 4 cannot be sufficiently reduced.

On the other hand, the allyl glycidyl ether functions as a cross-linking point during the cross-linking of GECO. Therefore, when the allyl glycidyl ether content is above the range, the cross-linking density of GECO becomes too high and the segmental motion of the molecule chain is obstructed, and thus in reverse, there is a tendency that the volume resistivity $R_2$ of the outer layer 4 increases.

The epichlorohydrin content in GECO is the remaining amount of the ethylene oxide content and the allyl glycidyl ether content. That is, the epichlorohydrin content is preferably more than 10 mol %, in particular, more than 19.5 mol %, and is preferably less than 69.5 mol %, in particular, less than 60 mol %.

In addition, GECO may be the copolymer in a narrow sense which is obtained by copolymerizing three monomers described above, as well as modified substance which is obtained by modifying the epichlorohydrin-ethylene oxide copolymer (ECO) with allyl glycidyl ether. In the present disclosure, any one of these GECOs can be used. One or more than two of these epichlorohydrin rubbers can be used.

<Diene Rubber>

The diene rubber functions to give excellent processability to the rubber composition, or to improve the mechanical strength or durability of the outer layer 4, or to give excellent properties as a rubber to the outer layer 4, that is, flexibility, low compression set and low tendency of deterioration.

Besides, the diene rubber is also a material which is oxide by the irradiation of ultraviolet rays to form the oxide film 9 on the surface of the outer layer 4, that is, on the outer periphery surface 8 of the roller body 5.

The diene rubber may be, for example, one or more than two of a natural rubber, an isoprene rubber (IR), a butadiene rubber (BR), a styrene butadiene rubber (SBR), a chloroprene rubber (CR), an acrylonitrile butadiene rubber (NBR) and the like. Wherein, a combined use of the CR and the NBR is preferable.

That is, preferably, the epichlorohydrin rubber, the CR and the NBR are used together as the rubber. In addition, the three kinds of rubbers may respectively be a combined use of two kinds of rubbers with different grades.

(CR)

In a combination system, the CR is a polar rubber, and thus functions to make fine adjustment to the volume resistivity $R_2$ of the outer layer 4.

The CR is synthesized by emulsion polymerizing chloroprene, and is classified into a sulfur modified type and a non-sulfur modified type in accordance with the type of molecular weight regulator used herein.

The sulfur modified CR herein is synthesized by plasticizing, with thiuram disulfide and the like, a polymer obtained by copolymerizing chloroprene and sulfur serving as a molecular weight regulator, to adjust to a predetermined viscosity. Besides, the non-sulfur modified CR is classified into, for example, mercaptan modified type, xanthogen modified type and the like.

Wherein, the mercaptan modified CR is synthesized in a way similar to the sulfur modified CR except that an alkyl mercaptan such as n-dodecyl mercaptan, tert-dodecyl mercaptan, octyl mercaptan and the like is used as the molecular weight regulator. Besides, the xanthogen modified CR is also synthesized in a way similar to the sulfur modified CR except that an alkyl xanthogen compound is used as the molecular weight regulator.

Besides, the CR is classified, based on the crystallization rate, into a type with a low crystallization rate, a type with a mediate crystallization rate, and a type with a high crystallization rate.

In the present disclosure, any type of CR can be used; wherein, the non-sulfur modified CR which has a low crystallization rate is preferable.

Besides, a copolymer of chloroprene and other copolymerizing component may be used as the CR. Other copolymerize components may be, for example, one or more than two of 2,3-dichloro-1,3-butadiene, 1-chloro-1,3-butadiene, styrene, acrylonitrile, methacrylonitrile, isoprene, butadiene, acrylic acid, acrylic acid ester, methacrylic acid, methacrylic acid ester and the like.

Furthermore, the CR may be an oil-extended CR to which extender oil is added to adjust the flexibility or a non-oil-extended CR without extender oil; in the present disclosure, in order to prevent the pollution from a photoreceptor, a non-oil-extended CR not containing extender oil which may become bleeding substance is preferably used.

One or more than two of these CRs can be used.

(NBR)

Any one of a low-nitrile NBR with an acrylonitrile content of less than 24%, a mediate-nitrile NBR with an acrylonitrile content of 25-30%, a mediate-high-nitrile NBR with an acrylonitrile content of 31-35%, high-nitrile NBR with an acrylonitrile content of 36-42%, extremely high-nitrile NBR with an acrylonitrile content of more than 43%, can be used as the NBR.

Besides, the NBR may be an oil-extended NBR to which extender oil is added to adjust the flexibility or a non-oil-extended NBR without extender oil; in the present disclosure, in order to prevent the pollution from a photoreceptor, a non-oil-extended NBR not containing extender oil which may become bleeding substance is preferably used.

One or more than two of these NBRs can be used.

(Combination Ratio of Rubber)

The combination ratio of the rubber can be optionally determined based on properties required by the outer layer 4, in particular, on the volume resistivity $R_2$ or the flexibility of the outer layer 4.

Meanwhile, the combination ratio of the epichlorohydrin rubber is preferably more than 10 parts by mass, in particular more than 15 parts by mass with respect to a total amount of 100 parts by mass of rubber, and is preferably less than 50 parts by mass, in particular less than 40 parts by mass.

If the combination ratio of the epichlorohydrin rubber is below the range, there is concern that the volume resistivity $R_2$ of the outer layer 4 cannot be sufficiently reduced to a suitable range.

On the other hand, when the combination ratio of the epichlorohydrin rubber is above the range, the ratio of the diene rubber is relatively low. Therefore, there is concern that excellent processability cannot be given to the rubber composition, excellent properties as a rubber cannot be given to the outer layer 4, or the continuous oxide film 9 having the above-mentioned functions cannot be formed on the outer periphery surface 8 of the roller body 5.

In view of this situation, by setting the combination ratio of the epichlorohydrin rubber to the above-mentioned range, effects obtained by the combined use with the diene rubber can be maintained, and the volume resistivity $R_2$ of the outer layer 4 can be sufficiently reduced to a suitable range.

The combination ratio of the CR is preferably more than 5 parts by mass with respect to 100 parts by mass of total rubber, and is preferably less than 15 parts by mass. If the combination ratio of the CR is below the range, there is concern that the effect obtained by using the CR, that is, the effect of making fine adjustment to the volume resistivity $R_2$ of the outer layer 4 is not sufficiently obtained.

On the other hand, when the combination ratio of the CR is above the range, the epichlorohydrin rubber becomes relatively less, and thus there is concern that the volume resistivity $R_2$ of the outer layer 4 cannot be sufficiently reduced to a suitable range.

The combination ratio of the NBR is the remaining amount of the epichlorohydrin rubber and the CR. That is, the combination ratio of the NBR may be determined in a way that when the combination ratio of the epichlorohydrin rubber and the CR is respectively set to a predetermined value, and the total amount of rubber becomes 100 parts by mass.

<Cross-Linking Component>

Preferably, a combination of a thiourea-based cross-linking agent and a sulfur-based cross-linking agent is used as the cross-linking component.

(Thiourea-Based Cross-Linking Agent)

Various thiourea compounds which have thiourea structures in molecules and mainly function as the cross-linking agent of the ECO and/or the GECO can be used as the thiourea-based cross-linking agent.

The thiourea-based cross-linking agent may be, for example, one or more than two of ethylene thiourea, N,N'-diphenyl thiourea, trimethyl thiourea, thiourea represented by formula (a):

$$(C_{n2n+1}NH)_2C{=}S \quad (a)$$

(wherein, n represents an integer of 1-12), tetramethyl thiourea and the like. In particular, the ethylene thiourea is preferable.

In consideration of giving the outer layer 4 the excellent properties as a rubber, the combination ratio of the thiourea-based cross-linking agent is preferably more than 0.1 parts by mass with respect to 100 parts by mass of total rubber, and is preferably less than 1 parts by mass.

(Cross-Linking Accelerator)

Various cross-linking accelerators which accelerate the cross-linking reaction of the ECO and/or GECO caused by the thiourea-based cross-linking agent may be used together with the thiourea-based cross-linking agent.

The cross-linking accelerator may be, for example, one or more than two of guanidine-based accelerators such as 1,3-diphenyl guanidine, 1,3-di-o-tolylguanidine, 1-o-tolylbiguanide and the like. In particular, 1,3-di-o-tolylguanidine is preferable. In consideration of sufficiently exhibiting the effect of accelerating the cross-linking reaction, the combination ratio of the cross-linking accelerator is preferably more than 0.1 parts by mass with respect to a total amount of 100 parts by mass of rubber, and is preferably less than 1 parts by mass.

(Sulfur-Based Cross-Linking Agent)

The sulfur-based cross-linking agent used mainly for cross-linking the diene rubber or the GECO may be, for example, sulfur such as powder sulfur, oil-treated powder sulfur, precipitated sulfur, colloidal sulfur, dispersible sulfur and the like, or an organic sulfur-containing compound such as tetramethylthiuram disulfide, N,N-dithio bis-morpholine and the like; in particular, sulfur is preferable.

In consideration of giving the outer layer 4 the excellent properties as a rubber, the combination ratio of sulfur is preferably more than 0.5 parts by mass with respect to 100 parts by mass of total rubber, and is preferable less than 2 parts by mass. In addition, for example, when oil-treated powder sulfur, dispersible sulfur and the like are used as sulfur, the combination ratio refers to the ratio of sulfur itself which serves as an effective component contained therein.

Besides, when an organic sulfur-containing compound is used as the cross-linking agent, the combination ratio is preferably adjusted so that the ratio of sulfur contained in the molecule with respect to 100 parts by mass of total rubber falls into the above-mentioned range.

(Cross-Linking Accelerator)

Various cross-linking accelerators which accelerates the cross-linking reaction of the diene rubber and the like caused by the sulfur-based cross-linking agent may be used together with the sulfur-based cross-linking agent.

The cross-linking accelerator may be, for example, one or more than two of a thiazole-based accelerator, a thiuram-based accelerator, a sulfenamide-based accelerator, a dithiocarbamate-based accelerator and the like. Wherein, a combined use of the thiazole-based accelerator and the thiuram-based accelerator is preferable. The thiazole-based accelerator may be, for example, one or more than two of 2-mercaptobenzothiazole, di-2-benzothiazolyl disulfide, a zinc salt of 2-mercaptobenzothiazole, a cyclohexylamine salt of 2-mercaptobenzothiazole, 2-(N,N-diethylthiocarbamoylthio) benzothiazole, 2-(4'-morpholinodithio) benzothiazole and the like. In particular, di-2-benzothiazolyl disulfide is preferable.

Besides, the thiuram-based accelerator may be, for example, one or more than two of tetramethylthiuram monosulfide, tetramethylthiuram disulfide, tetraethylthiuram disulfide, tetrabutylthiuram disulfide, tetrakis(2-ethylhexyl)thiuram disulfide, dipentamethylene thiuram tetrasulfide. In particular, tetramethylthiuram monosulfide is preferable.

In consideration of sufficiently exhibiting the effect of accelerating the cross-linking reaction, in a combination system of two above-mentioned cross-linking accelerators, the combination ratio of the thiazole-based accelerator is preferably more than 1 parts by mass and less than 2 parts by mass with respect to a total amount of 100 parts by mass of rubber. Besides, the combination ratio of the thiuram-based accelerator is preferably more than 0.1 parts by mass and less than 1 parts by mass with respect to a total amount of 100 parts by mass of rubber.

<Conductive Agent>

Furthermore, a salt (ionic salt) of an anion and a cation which has a fluoro group and a sulphonyl group in the molecule, which serves as a conductive agent, may be added to the rubber composition for the outer layer 4.

By adding an ionic salt as the conductive agent, the ion conductivity of the rubber composition is further improved, and the volume resistivity $R_2$ of the outer layer 4 can be further reduced.

The anion which forms the ionic salt and has a fluoro group and a sulphonyl group in a molecule may be, for example, one or more than two of fluoroalkyl sulfonic acid ion, bis (fluoroalkyl sulfonyl) imide ion, tris (fluoroalkyl sulfonyl) methide ion and the like.

Wherein, the fluoroalkyl sulfonic acid ion may be, for example, one or more than two of $CF_3SO_3^-$, $C_4F_9SO_3^-$ and the like.

Besides, the bis (fluoro alkyl sulfonyl) imide ion may be, for example, one or more than two of $(CF_3SO_2)_2N$, $(C_2F_5SO_2)_2N^-$, $(C_4F_9SO_2)(CF_3SO_2)N^-$, $(FSO_2C_6F_4)(CF_3SO_2)N^-$, $(C_8F_{17}SO_2)(CF_3SO_2)N(CF_3CH_2OSO_2)_2N^-$, $(CF_3CF_2CH_2OSO_2)_2N$ $(HCF_2CF_2CH_2OSO_2)_2N^-$, $[(CF_3)_2CHOSO_2]_2N^-$ and the like.

Furthermore, the tris(fluoroalkyl sulfonyl) methide ion may be, for example, one or more than two of $(CF_3SO_2)_3C^-$, $(CF_3CH_2OSO_2)_3C^-$ and like. Besides, the cation may be, for example, one or more than two of ions of alkali metals such as sodium, lithium, potassium, ions of group II elements such as beryllium, magnesium, calcium, strontium, barium, ions of transitional elements, cations of amphoteric elements, quaternary ammonium ions, imidazolium cations and the like.

As for the ionic salt, a lithium salt which uses lithium ion as the cation or a potassium salt which uses potassium ion is particularly preferable.

Wherein, in terms of the effect of improving the ion conductivity of the rubber composition and reducing the volume resistivity $R_2$ of the outer layer 4, $(CF_3SO_2)_2NLi$[lithium bis (trifluoromethane sulfonyl) imide Li-TFSI], and/or $(CF_3SO_2)_2NK$[potassium bis(trifluoromethane sulfonyl)imide, K-TFSI] are/is preferable.

The combination ratio of the ionic salt is preferably more than 0.5 parts by mass with respect to a total amount of 100 parts by mass of rubber, and is preferably less than 2 parts by mass.

<Others>

Various additive agents may be further combined into the rubber composition when necessary. The additive agent may be, for example, a cross-linking accelerator aid, an acid acceptor, a filler, a plasticizer, a processing aid, a deterioration inhibitor and the like.

Wherein, the cross-linking accelerator aid may be, for example, one or more than two of metal compounds such as zinc oxide (zinc flower), fatty acid such as stearic acid, oleic acid, cotton seed oil fatty acid, and other publicly known cross-linking accelerator aids.

The combination ratio of the cross-linking accelerator aid is individually preferably more than 0.1 parts by mass with respect to a total amount of 100 parts by mass of rubber, and is preferably less than 7 parts by mass.

The acid acceptor functions to avoid the residues of a chlorine-based gas inside the outer layer 4 which is generated from the epichlorohydrin rubber or the CR during cross-linking, and the inhibition to the cross-linking caused by the residues or pollution of a photoreceptor and so on.

Various substance acting as acid receptors can be used as the acid acceptor; wherein, a hydrotalcite type of acid receptor or MAGSARAT with excellent dispersibility is preferable, in particular, the hydrotalcite type of acid receptor is preferable.

Besides, when the hydrotalcite type of acid receptor is used together with a magnesium oxide or a potassium oxide, a higher acid accepting effect can be obtained, and the pollution of a photoreceptor can be further reliably prevented.

The combination ratio of the acid acceptor is preferably more than 0.1 parts by mass with respect to a total amount of 100 parts by mass of rubber, and is preferably less than 7 parts by mass.

The filler may be, for example, one or more than two of a zinc oxide, silica, carbon black, clay, talc, calcium carbonate, magnesium carbonate, aluminum hydroxide and the like.

By adding the filler, the mechanical strength and the like of the development roller can be improved.

Besides, if conductive carbon black is used as the filler, electronic conductivity can be given to the roller body.

The conductive carbon black may be, for example, acetylene black and the like.

The combination ratio of the conductive carbon black is preferably more than 6 parts by mass with respect to a total amount of 100 parts by mass of rubber, and is preferably less than 9 parts by mass.

The plasticizer may be, for example, various plasticizers such as dibutyl phthalate, dioctyl phthalate, tricresyl phosphate, or various waxes such as a polar wax. Besides, the processing aid may be, for example, a fatty acid metal salt such as stearic acid zinc.

The combination ratio of the plasticizer and/or the processing aid is preferably less than 3 parts by mass with respect to a total amount of 100 parts by mass of rubber.

Besides, a deterioration inhibitor, various additive agents such as an anti-scorching agent, a lubricant, a pigment, an antistatic agent, a flame retardant, a neutralizer, a nucleating agent, a co-cross-linking agent may be further added at an optional ratio as the additive agent.

<Preparation of Rubber Composition>

The rubber composition for the outer layer 4 containing the component described above can be prepared in an existing way. First, the rubber is masticated, next, various additive agents except the cross-linking component are added for kneading, and the cross-linking component is added at last for kneading, thereby obtaining the rubber composition for the outer layer 4. The kneading can be performed by, for example, a kneader, a banbury mixer, an extruding machine and the like.

«Manufacturing of the Development Roller 1»

When the rubber composition for the inner layer 2 and the outer layer 4 is used to manufacture the development roller 1 in the example of FIG. 1A and FIG. 1B, for example, the two kinds of rubber composition are supplied to a two-layer extruding machine and are coextruded in a laminated two-layer tubular shape, followed by the cross-linking of the whole to form the inner layer 2 and the outer layer 4.

Alternatively, the rubber composition for the inner layer 2 is extruded in a tubular shape and is cross-linked to form the inner layer 2; next, a sheet of the rubber composition for the outer layer 4 is wound on the outer periphery surface 3 and formed to a tubular shape by pressing, then is integrated with the inner layer 2 to form the outer layer 4 during the cross-linking.

Next, the formed laminated body of the inner layer 2 and the outer layer 4 is heated by an oven and the like for a secondary cross-linking, and is polished after cooling so as to obtain a predetermined external diameter, after which the roller body 5 comprising the laminated body is formed.

A thickness of the inner layer 2 can be optionally set in accordance with the structure and size of the image-forming device to be incorporated.

Also, a thickness of the outer layer 4 can be optionally set, but is preferably more than 0.1 mm and is preferably less than 2 mm.

By setting the thickness of the outer layer 4 having a predetermined volume resistivity $R_2$ to this range, when the outer layer 4 is combined with the inner layer 2 having a predetermined roller resistance value $R_1$, the roller resistance value $R_3$ of the whole roller body 5 can be adjusted to the above-mentioned range. Therefore, both the black solid density and the 2-dot density are simultaneously improved, and the effect of forming a satisfactory image having excellent contrast and thin line reproducibility can be further improved.

Various polishing method, for example, a dry traverse polishing and the like can be used as the polishing method. Besides, at the end of the polishing process, mirror polishing may be performed for trimming. In this case, mold release characteristics of the outer periphery surface 8 is improved, and adhesion of the toner can be more effectively suppressed without forming the oxide film 9 or by a synergistic effect of the formation of the oxide film 9. Also, the pollution of a photoreceptor and the like can be effectively prevented.

The shaft 7 can be inserted and fixed into the through hole 6 at any time from the cutting of a cylindrical body from which the roller body 5 is originated to the polishing. However, preferably, after the cutting, the secondary cross-linking and the polishing are performed in a state that the shaft 7 is already inserted into the through hole 6. Accordingly, warpage or distortion of the roller body 5 caused by the expansion and contraction during the secondary cross-linking can be suppressed. In addition, by being polished while rotating around the shaft 7, the workability of polishing can be improved, and deflection of the outer periphery surface 8 can be suppressed.

As described above, the shaft 7 may be inserted into the through hole 6 by pressing a shaft 7, which has an external diameter larger than the internal diameter of the through hole 6, into the through hole 6, or be inserted into the through hole 6 of a cylindrical body before the secondary cross-linking via a thermosetting adhesive agent having conductivity.

In the former case, electrical coupling and mechanical fixation are finished simultaneously with the pressing of the shaft 7.

Besides, in the latter case, by the heating in the oven, the thermosetting adhesive agent hardens simultaneously with the secondary cross-linking of the cylindrical body, and the shaft 7 is mechanically fixed to the roller body 5 while being electrically coupled to the roller body 5.

As described above, the oxide film 9 is preferably formed by the irradiation of ultraviolet rays to the surface of the outer layer 4, namely the outer periphery surface 8 of the roller body 5. That is, the oxide film 9 can be formed simply by the irradiation of ultraviolet rays with a predetermined wavelength to the outer periphery surface 8 of the roller body 5 for a predetermined duration to oxidize the rubber near the outer periphery surface 8, and thus the formation is easily and efficiently done.

Moreover, the oxide film 9 formed by the irradiation of ultraviolet rays does not have such problems as, for example, a conventional coating film which is formed by coating a coating agent, and is excellent in the uniformity of thickness or the adhesion with the roller body 5.

In consideration of efficiently oxidizing the diene rubber in the rubber composition for the outer layer 4 to form an oxide film 9 with the excellent functions, the wavelength of the irradiated ultraviolet rays is preferably more than 100 nm, and is preferably less than 400 nm, in particular less than 300 nm. Besides, the irradiation duration is preferably longer than 30 seconds, in particular longer than 1 minute, and is preferably shorter than 30 minutes, in particular shorter than 20 minutes.

Meanwhile, the oxide film 9 may also be formed by other methods, or may not be formed in some cases.

One or two layers of any interlayer may be interposed between the inner layer 2 and the outer layer 4. However, in consideration of simplifying the structure of the roller body 5, the roller body 5 is preferably a two-layer structure in which the inner layer 2 and the outer layer 4 are directly laminated as the example in FIG. 1A and FIG. 1B.

The development roller 1 of the present disclosure can be incorporated to be used in various image-forming devices using electrophotography, for example, a laser printer, an electrostatic copying machine, a plain paper facsimile device, and a compound machine thereof.

EXAMPLES

In the following part, the present disclosure is further described based on practical examples and comparative examples; however, the configuration of the present disclosure is not necessarily limited to the practical examples and comparative examples.

<Rubber Composition (A) for the Inner Layer 2>

78 parts by mass of IR [Nipol (registered trademark) IR2200 manufactured by Zeon Corporation, non-oil-extended] and 22 parts by mass of EPDM [Esprene (registered trademark) 505A manufactured by Sumitomo Chemical Company, Ltd., non-oil-extended] are used as the rubber.

The following components are formulated and kneaded while the total amount of 100 parts by mass of rubber is masticated by a banbury mixer.

TABLE 1

| Component | Parts by mass |
|---|---|
| Carbon black | 6.0 |
| Cross-linking accelerator aid | 2.5 |

TABLE 1-continued

| Component | Parts by mass |
|---|---|
| Processing aid | 0.5 |
| Oxidation inhibitor | 1.0 |

Each component in Table 1 is as follows. Besides, the parts by mass in the table is the parts by mass with respect to a total amount of 100 parts by mass of rubber.

Carbon black: Lionite CB manufactured by the Lion Corporation

Cross-linking accelerator aid: two kinds of zinc oxide, manufactured by Sakai Chemical Industry Co., Ltd.

Processing aid: zinc stearate, SZ-2000 manufactured by Sakai Chemical Industry Co., Ltd. Oxidation inhibitor: 4,4'-dicumyl diphenylamine, NONFLEX (registered trademark) DCD manufactured by Seiko Chemical Co., Ltd.

Next, while the kneading continues, the following cross-linking components are formulated and further kneaded to prepare a rubber composition (A) for the inner layer 2.

TABLE 2

| Component | Parts by mass |
|---|---|
| Accelerator DM | 1.5 |
| Accelerator TS | 0.5 |
| Sulfur | 1.05 |

Each component in Table 2 is as follows. Besides, the parts by mass in the table is the parts by mass with respect to a total amount of 100 parts by mass of rubber. Accelerator DM: di-2-benzothiazolyl disulfide, Nocceler (registered trademark) DM manufactured by Ouchi Shinko Chemical Industrial Co., Ltd., a thiazole-based accelerator Accelerator TS: tetramethylthiuram monosulfide, Sanceler (registered trademark) TS manufactured by Sanshin Chemical Industry Co., Ltd., a thiuram-based accelerator Sulfur: a cross-linking agent, "Golden Flower" sulfur powder with 5% of oil manufactured by Tsurumi Chemical Industry Co., Ltd.

<Rubber Composition (B) for the Inner Layer 2>

A rubber composition (B) for the inner layer 2 is prepared in a way similar to the rubber composition (A) except that the combination ratio of carbon black is set to 6.3 parts by mass with respect to a total amount of 100 parts by mass of rubber.

<Rubber Composition (C) for the Inner Layer 2>

A rubber composition (C) for the inner layer 2 is prepared in a way similar to the rubber composition (A) except that the combination ratio of carbon black is set to 6.66 parts by mass with respect to 100 parts by mass of total rubber.

<Rubber Composition (D) for the Inner Layer 2>

A rubber composition (D) for the inner layer 2 is prepared in a way similar to the rubber composition (A) except that the combination ratio of carbon black is set to 7.16 parts by mass with respect to 100 parts by mass of total rubber.

<Measurement of the Roller Resistance Value $R_1$ of the Inner Layer 2>

The rubber composition (A)-(D) for the inner layer 2 is extruded to form a cylindrical shape with an external diameter ϕ of 16 mm and an internal diameter ϕ of 6 mm, mounted to a temporary shaft for the cross-linking and cross-linked in a vulcanization can under 160° C. for an hour.

Next, the cross-linked cylindrical body is mounted on the shaft 7 made of metal, to which a conductive thermosetting adhesive agent is coated on the outer periphery surface and which has the same external diameter ϕ of 7.5 mm as the shaft actually used in the manufacturing of the development roller 1, and is heated to 160° C. in an oven to be adhered to the shaft 7.

Next, two ends of the cylindrical body are shaped, and the outer periphery surface 3 is traverse polished using a cylindrical polishing machine, followed by a mirror polishing serving as a trimming to be trimmed so that the external diameter ϕ becomes 16 mm; furthermore, water washing is performed and the inner layer 2 integral with the shaft 7 is formed.

Then, the roller resistance value $R_1$ in a state when there is only the formed inner layer 2 (Ω, an applied voltage of 400 V) is measured by the measuring method described above.

<Rubber Composition (I) for the Outer Layer 4>

30 parts by mass of GECO [EPION (registered trademark) 301L manufactured by Osaka Soda Co., Ltd., EO/EP/AGE-73/23/4 (molar ratio)], 10 parts by mass of CR [Showa Denko Chloroprene (registered trademark) WRT manufactured by Showa Denko K.K., non-oil-extended], and NBR [Nipol (registered trademark) DN401LL manufactured by Zeon Corporation, a low-nitrile NBR, bonded acrylonitrile: 18.0% (center value), non-oil-extended] are used as the rubber.

The following components are formulated and kneaded while the total amount of 100 parts by mass of rubber is masticated using a banbury mixer.

TABLE 3

| Component | Parts by mass |
|---|---|
| Ionic salt | 1.0 |
| Cross-linking accelerator aid | 2.5 |
| Filler | 7.5 |
| Acid acceptor | 3.0 |
| Processing aid | 0.5 |

Each component in Table 3 is as follows. Besides, the parts by mass in the table is the parts by mass with respect to a total amount of 100 parts by mass of rubber. Ionic salt: potassium bis (trifluoromethanesulfonyl) imide, EF-N112, K-TFSI manufactured by Mitsubishi Materials Electronic Chemicals Co., Ltd.

Cross-linking accelerator aid: two kinds of zinc oxide, manufactured by Sakai Chemical Industry Co., Ltd.

Filler: conductive carbon black, Denka Black (registered trademark) and acetylene black manufactured by Denka Company Limited, particles Acid acceptor: hydrotalcite type, DHT-4A (registered trademark)-2 manufactured by Kyowa Chemical Industry Co., Ltd.

Processing aid: zinc stearate, SZ-2000 manufactured by Sakai Chemical Industry Co., Ltd. Next, while the kneading continues, the following cross-linking components are formulated and further kneaded to prepare a rubber composition (I) for the outer layer 4.

TABLE 4

| Component | Parts by mass |
|---|---|
| Accelerator DM | 1.5 |
| Accelerator TS | 0.5 |
| Sulfur | 1.05 |
| Thiourea-based cross-linking agent | 0.3 |
| Accelerator DT | 0.2 |

Each component in Table 4 is as follows. Besides, the parts by mass in the table is the parts by mass with respect to 100 parts by mass of total rubber.

Accelerator DM: di-2-benzothiazolyl disulfide, the Nocceler DM manufactured by Ouchi Shinko Chemical Industrial Co., Ltd., a thiazole-based accelerator Accelerator TS: tetramethyl thiuram monosulfide, the Sanceler TS manufactured by Sanshin Chemical Industry Co., Ltd., a thiuram-based accelerator Sulfur: a cross-linking agent, the "GOLDEN FLOWER" sulfur powder with 5% of oil, manufactured by Tsurumi Chemical Industry Co., Ltd.

Thiourea-based cross-linking agent: ethylene thiourea, Accel (registered trademark) 22-S manufactured by Kawaguchi Chemical Industry Co., Ltd, 2-mercapto imidazoline Accelerator DT: 1, 3-di-o-tolylguanidine, Sanceler DT manufactured by Sanshin Chemical Industry Co., Ltd., guanidine-based accelerator <Rubber Composition (II) for the Outer Layer 4>

A rubber composition (II) for the outer layer 4 is prepared in a way similar to the rubber composition (I) except that the combination ratio of GECO is set to 20 parts by mass and the combination ratio of NBR is set to 70 parts by mass.

<Rubber Composition (III) for the Outer Layer 4>

A rubber composition (III) for the outer layer 4 is prepared in a way similar to the rubber composition (I) except that the combination ratio of GECO is set to 15 parts by mass and the combination ratio of NBR is set to 75 parts by mass.

<Rubber Composition (IV) for the Outer Layer 4>

A rubber composition (IV) for the outer layer 4 is prepared in a way similar to the rubber composition (I) except that the combination ratio of GECO is set to 40 parts by mass, the combination ratio of NBR is set to 50 parts by mass, and the combination ratio of the conductive carbon black is set to 15 parts by mass with respect to a total amount of 100 parts by mass of rubber.

<Rubber Composition (V) for the Outer Layer 4>

A rubber composition (V) for the outer layer 4 is prepared in a way similar to the rubber composition (I) except that the combination ratio of GECO is set to 15 parts by mass, the combination ratio of NBR is set to 75 parts by mass, and ionic salt is not added.

<Measurement of the Volume Resistivity $R_2$ of the Outer Layer 4>

The rubber composition (I)-(V) for the outer layer 4 is extruded to form a sheet under 160° C. for an hour. Then, the volume resistivity of the formed sheet is measured by a measuring method described above and is set as the volume resistivity $R_2$ in a state when there is only the outer layer 4 (Ω·cm, an applied voltage of 400 V).

<Practical Examples 1-8, Comparative Examples 1-3>

The rubber composition (A)-(D) for the inner layer 2 and the composition (I)-(V) for the outer layer 4 are supplied to a two layer extruding machine in the combinations shown in Table 5-7, extruded to form a two layer cylindrical shape which has an external diameter ϕ of 16 mm and an internal diameter ϕ of 6 mm, and for which a thickness of the cylindrical body from which the inner layer 2 is originated is 3.5 mm, and mounted to a temporary shaft for cross-linking to be cross-linked in a vulcanization can under 160° C. for an hour.

Next, the cross-linked cylindrical body is mounted again to the shaft 7 made of metal, to which a conductive thermosetting adhesive agent is coated on the outer periphery surface and which has an external diameter ϕ of 7.5 mm, and is heated to 160° C. in an oven to be adhered to the shaft 7.

Next, two ends of the cylindrical body are shaped, and the outer periphery surface 8 is traverse polished using a cylindrical polishing machine, followed by a mirror polishing serving as a trimming to be trimmed so that the external diameter ϕ becomes 16 mm, forming the roller body 5 which has a two-layer structure of the inner layer 2 and the outer layer 4 and which is integral with the shaft 7. The thickness of the outer layer 4 is about 0.5 mm.

Next, the outer periphery surface 8 of the formed roller body 5 is wiped with alcohol and is arranged to be set to an ultraviolet ray irradiation device [PL21-200 manufactured by Sen Lights Co., Ltd.] so that a distance from the outer periphery surface 8 to an UV lamp is 50 mm. Then, by the irradiation of ultraviolet rays with wavelengths of 184.9 nm and 253.7 nm every 15 minutes during a rotation around the shaft for every 90°, the oxide film 9 is formed on the outer periphery surface 8 to make the development roller 1.

<Comparative Examples 4-7>

The composition (I)-(V) for the outer layer 4 is used individually to be extruded to form a cylindrical shape having an external diameter ϕ of 16 mm and an internal diameter ϕ of 6 mm, and is mounted to a temporary shaft for cross-linking to be cross-linked in a vulcanization can under 160° C. for an hour.

Next, the cross-linked cylindrical body is mounted again to the shaft 7 made of metal, to which a conductive thermosetting adhesive agent is coated on the outer periphery surface and which has an external diameter ϕ of 7.5 mm, and is heated to 160° C. in an oven to be adhered to the shaft 7.

Next, two ends of the cylindrical body are shaped, and the outer periphery surface 8 is traverse polished using a cylindrical polishing machine, followed by a mirror polishing serving as a trimming to be trimmed so that the external diameter ϕ becomes 16 mm, forming the roller body which has a single layer structure including the composition for the outer layer 4 and which is integral with the shaft 7.

Next, the outer periphery surface of the formed roller body 5 is wiped with alcohol and is arranged to be set to an ultraviolet ray irradiation device [PL21-200 manufactured by Sen Lights Co., Ltd.] so that a distance from the outer periphery surface to an UV lamp is 50 mm. Then, by the irradiation of ultraviolet rays with wavelengths of 184.9 nm and 253.7 nm every 15 minutes during a rotation around the shaft for every 90°, an oxide film is formed on the outer periphery surface to make the development roller.

<Measurement of the Roller Resistance Value $R_3$ of the Whole Roller Body 5>

The roller resistance value $R_3$ of the whole roller body 5 of the development roller 1 that is made (Ω, an applied voltage of 400 V) is measured by the measuring method described above.

<Measurement of Black Solid Density>

Incorporate the development roller to a laser printer which uses a positive charge type nonmagnetic single-component toner and is capable of printing about 4000 pieces (A4 size, published value in Japanese Industrial Standard JIS X6932: 2008), and continuously fonn 30 pieces of images of 1% density on plain paper at a temperature of 23.5° C. and a relative humidity of 55%, immediately followed by the formation of one piece of a black solid image.

At five optional points in the black solid image that is formed, the image density is measured using a reflection-type densitometer [a combination of Techkon RT120 and Light Table LP20 manufactured by TECHKON], and an average value is calculated and set as the black solid density. A black solid density above 1.30 is regarded as qualified.

<Measurement of 2-Dot Density>

Similar to the black solid density, immediately after 4000 pieces of images of 1% density are continuously formed on plain paper, one piece of isolated 2-dot image is formed in which circles are positioned in parallel on a square grid with a grid length of about 80 μm.

At five optional points in the isolated 2-dot image that is formed, the image density is measured using the same reflection-type densitometer, and an average value is calculated and set as the 2-dot density. A 2-dot density above 0.025 is regarded as qualified.

The results of the measurements above are shown in Table 5-Table 7.

TABLE 5

| | | Practical example 1 | Practical example 2 | Practical example 3 | Practical example 4 | Practical example 5 |
|---|---|---|---|---|---|---|
| Inner layer 2 | Type | A | A | A | A | B |
| | $\log R_1$ | 9.3 | 9.3 | 9.3 | 9.3 | 7.8 |
| Outer layer 4 | Type | I | II | III | IV | II |
| | $\log R_2$ | 7.4 | 8.0 | 8.9 | 6.1 | 8.0 |
| Roller body 5 | $\log R_3$ | 8.5 | 8.6 | 8.7 | 8.6 | 7.0 |
| Black solid density | Value | 1.39 | 1.37 | 1.33 | 1.35 | 1.35 |
| | Evaluation | ○ | ○ | ○ | ○ | ○ |
| 2-dot density | Value | 0.129 | 0.125 | 0.110 | 0.110 | 0.072 |
| | Evaluation | ○ | ○ | ○ | ○ | ○ |

TABLE 6

| | | Practical example 6 | Practical example 7 | Practical example 8 | Comparative example 1 | Comparative example 2 |
|---|---|---|---|---|---|---|
| Inner layer 2 | Type | B | C | C | A | D |
| | $\log R_1$ | 7.8 | 6.6 | 6.6 | 9.3 | 5.7 |
| Outer layer 4 | Type | I | II | I | V | II |
| | $\log R_2$ | 7.4 | 8.0 | 7.4 | 9.6 | 8.0 |
| Roller body 5 | $\log R_3$ | 7.1 | 5.6 | 5.7 | 9.0 | 6.2 |
| Black solid | Value | 1.35 | 1.34 | 1.33 | 1.25 | 1.31 |

TABLE 6-continued

| | | Practical example 6 | Practical example 7 | Practical example 8 | Comparative example 1 | Comparative example 2 |
|---|---|---|---|---|---|---|
| density | Evaluation | ○ | ○ | ○ | x | ○ |
| 2-dot | Value | 0.066 | 0.032 | 0.028 | 0.135 | 0.011 |
| density | Evaluation | ○ | ○ | ○ | ○ | x |

TABLE 7

| | | Comparative example 3 | Comparative example 4 | Comparative example 5 | Comparative example 6 | Comparative example 7 |
|---|---|---|---|---|---|---|
| Inner | Type | D | — | — | — | — |
| layer 2 | $\log R_1$ | 5.7 | — | — | — | — |
| Outer | Type | I | I | II | III | V |
| layer 4 | $\log R_2$ | 7.4 | 7.4 | 8.0 | 8.9 | 9.6 |
| Roller body 5 | $\log R_3$ | 5.8 | 5.7 | 6.2 | 7.0 | 7.7 |
| Black solid | Value | 1.32 | 1.35 | 1.33 | 1.29 | 0.90 |
| density | Evaluation | ○ | ○ | ○ | x | x |
| 2-dot | Value | 0.010 | 0.011 | 0.015 | 0.018 | 0.040 |
| density | Evaluation | x | x | x | x | ○ |

According to the results of the practical examples 1-8 and the comparative examples 1-7 in each table, it is determined that by combining the inner layer 2 for which the roller resistance value $R_1$ satisfies the above-mentioned formula (1) and the outer layer 4 for which the volume resistivity $R_2$ satisfies formula (2), a development roller can be provided which is capable of simultaneously improving the black solid density and the 2-dot density to form an image having excellent contrast and thin line reproducibility. Besides, according to the results of the practical examples 1-8, it is also understood that in consideration of further improving the above-mentioned effect, the roller resistance value $R_3$ of the whole roller body 5 obtained by the combination of the inner layer 2 and the outer layer 4 preferably satisfies formula (3).

What is claimed is:

1. A development roller comprising a roller body, wherein the roller body comprises a tubular inner layer which consists of an elastic material and an outer layer which consists of an elastic material and is laminated on an outer periphery surface of the inner layer, the outer layer consists of a cross-linked product of a rubber composition, wherein the rubber composition of the outer layer contains an epichlorohydrin rubber and a diene rubber, and a roller resistance value $R_1$ (Ω, an applied voltage of 400 V) in a state when there is only the inner layer satisfies formula (1):

$$6.5 \leq \log R_1 \leq 9.5 \quad (1),$$

and a volume resistivity $R_2$ (Ω·cm, an applied voltage of 400 V) in a state when there is only the outer layer satisfies formula (2):

$$\log R_2 \leq 9.0 \quad (2).$$

2. The development roller according to claim 1, wherein the inner layer consists of a cross-linked product of a rubber composition containing a diene rubber, an ethylene propylene diene rubber, and carbon black.

3. The development roller according to claim 1, wherein the roller body further comprises an oxide film arranged on an outer periphery surface of the outer layer.

4. The development roller according to claim 2, wherein the roller body further comprises an oxide film arranged on an outer periphery surface of the outer layer.

5. The development roller according to claim 1, wherein a roller resistance value $R_3$ (Ω, an applied voltage of 400 V) of the roller body including the inner layer and the outer layer satisfies formula (3):

$$5.0 \leq \log R_3 \leq 8.7 \quad (3).$$

6. The development roller according to claim 1, wherein the inner layer consists of a cross-linked product of a rubber composition containing an isoprene rubber, an ethylene propylene diene rubber, and carbon black.

7. The development roller according to claim 1, wherein the diene rubber of the outer layer contains a chloroprene rubber and an acrylonitrile butadiene rubber.

8. The development roller according to claim 7, wherein a combination ratio of the epichlorohydrin rubber is from 10 parts by mass or more to 50 parts by mass or less with respect to a total amount of 100 parts by mass of rubber.

9. The development roller according to claim 8, wherein a combination ratio of the chloroprene rubber is from 5 parts by mass or more to 15 parts by mass or less with respect to a total amount of 100 parts by mass of rubber.

10. The development roller according to claim 1, wherein a thickness of the outer layer is from 0.1 mm or more to 2 mm or less.

11. The development roller according to claim 1, wherein the rubber composition of the outer layer further contains an ionic salt, wherein the ionic salt is a salt of an anion and a cation having a fluoro group and a sulphonyl group in the molecule.

12. The development roller according to claim 11, wherein a combination ratio of the ionic salt is from 0.5 parts by mass or more to 2 parts by mass or less with respect to a total amount of 100 parts by mass of rubber.

* * * * *